US006199307B1

(12) United States Patent
Kagoshima et al.

(10) Patent No.: US 6,199,307 B1
(45) Date of Patent: Mar. 13, 2001

(54) BATTERY-POWERED WORKING MACHINE

(75) Inventors: Masayuki Kagoshima, Kobe; Hideki Kinugawa, Hiroshima, both of (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/321,546

(22) Filed: May 28, 1999

(30) Foreign Application Priority Data

Jun. 1, 1998 (JP) ..... 10-151465

(51) Int. Cl.[7] ..... F16D 31/02; E02F 3/32

(52) U.S. Cl. ..... 37/443; 60/420

(58) Field of Search ..... 37/348, 443, 466, 37/905; 414/685, 686, 687, 917, 918, 718, 728; 180/9.1, 234, 167; 701/50; 60/400, 420, 431

(56) References Cited

U.S. PATENT DOCUMENTS 3,738,057 * 6/1973 Ogasawara ..... 46/243
4,917,213 * 4/1990 Kessler et al. ..... 182/2
5,193,633 * 3/1993 Ezenwa ..... 180/65.1
5,647,721 * 7/1997 Rohrbaugh ..... 414/686
5,913,811 * 6/1999 Kinugawa et al. ..... 60/420

* cited by examiner

*Primary Examiner*—Robert E. Pezzuto
(74) *Attorney, Agent, or Firm*—Oblon, Spivak, McClelland, Maier, & Neustadt, P.C.

(57) ABSTRACT

It is intended to keep low the moment of inertia of a boom, etc. and maintain the whole of a working machine in good weight balance. At the same time, a highly efficient recovery of energy is to be attained to increase a continuous working time of a battery. A battery-powered working machine using a battery as a power source is provided. Rotation of a rotatable superstructure 12 and rising and falling motions of a boom 28 are performed directly by electric motors 22 and 34. The recovery of energy is attained by utilizing the electric motors 22 and 34. An arm 30 and a bucket 32 both located remote from a centroid position of the machine are actuated by an arm cylinder 38 and a bucket cylinder 40, which are hydraulic actuators less heavy than electric motors. Further, a hydraulic pump 18 for supplying those hydraulic actuators with a hydraulic oil is actuated by a hydraulic pump actuating electric motor 20 which utilizes the battery 14 as a power source.

7 Claims, 4 Drawing Sheets

BATTERY-POWERED WORKING MACHINE

BACKGROUND OF THE INVENTION

1. Field of the Invention

The present invention relates to a working machine such as an excavator which is operated using a battery as a drive source.

2. Description of the Prior Art

Usually, in a conventional working machine such as a hydraulic excavator, a hydraulic pump is actuated by utilizing the power of an engine mounted for traveling and a hydraulic oil discharged from the hydraulic pump is fed to various hydraulic actuators such as a rotating motor, a boom cylinder and an arm cylinder to actuate various portions. However, in such a machine utilizing the engine power, there is a fear that noises and exhaust gases generated from the engine may exert a bad influence on the working site environment. For this reason it is the present situation that strict restrictions are placed on operations in cities and towns and in tunnels, further, on night operations.

In an effort to eliminate such bad influence there has recently been proposed a working machine wherein an electric motor is rotated by utilizing the electric power of a battery mounted on the working machine and a hydraulic pump is actuated by the electric motor (see, for example, Japanese Patent Laid Open No. 9-144061).

The battery mounted on the above working machine is lower in energy density (energy capable of being stored per unit mass) than fossil fuels such as gasoline and gas oil which are engine fuels. Thus, battery-powered working machine is disadvantageous in that the continuous working time is short as compared with working machines which utilize the engine power. As an example of means for increasing the continuous working time there is mentioned a means wherein energy is recovered when a negative work such as boom lowering or rotation braking work is performed and it is regenerated in the battery (that is, the attainment of a high efficiency is intended by energy regeneration). However, a large number of valves, including electromagnetic proportion valves, are mounted on a hydraulic excavator or the like and there occurs a large pressure loss or relief loss in those valves, so that it is very difficult to effect an efficient recovery of energy to the battery through the medium of such a hydraulic circuit.

If the operation of the boom and the rotation are conducted directly with use of an electric motor which is driven by a battery, without using such a hydraulic circuit, it will be possible to effect an efficient recovery of energy. However, in comparison with the hydraulic actuator, such an electric motor is smaller in the force and torque which it can generate per unit weight; besides, a reduction mechanism is required. Thus, the use of such a battery-powered electric motor is disadvantageous in that moving portions becomes more complicated in structure than in the use of a hydraulic actuator. The weight of moving portions also increases. Therefore, if the electric motor in question is provided at the front end of a boom, not only the moment of inertia of the boom and that of the entire swing structure will become larger, but also the weight balance of the entire working machine will become unstable.

SUMMARY OF THE INVENTION

The present invention has been accomplished in view of the above-mentioned circumstances and it is an object of the invention to provide a battery-powered working machine capable of keeping low the moment of inertia of a boom, etc. and capable of effecting a highly efficient recovery of energy to increase the continuous working time while maintaining the entire working machine in good weight balance.

According to the present invention, for achieving the above-mentioned object, there is provided in one aspect thereof a battery-powered working machine including a boom attached to a body of the working machine so as to be capable of rising and falling, a working portion attached to the boom, and a battery as a drive source, the working machine further including a boom actuating electric motor which is supplied with electric power from the battery and which actuates the boom directly, a hydraulic pump actuating electric motor which is supplied with electric power from the battery and which actuates a hydraulic pump, the hydraulic pump which is actuated by the hydraulic pump actuating electric motor and which discharges a hydraulic oil, and a hydraulic actuator which is supplied with the hydraulic oil discharged from the hydraulic pump and which actuates the working portion attached to the boom.

According to the present invention there is provided in another aspect thereof a battery-powered working machine including a rotatable superstructure carried rotatably on a lower carriage, a boom attached to the rotatable superstructure so as to be capable of rising and falling, a working portion attached to the boom, and a battery as a drive source, the working machine further including a rotating electric motor which is supplied with electric power from the battery and which directly causes the rotatable superstructure to rotate, a hydraulic pump actuating electric motor which is supplied with electric power from the battery and which actuates a hydraulic pump, the hydraulic pump which is actuated by the hydraulic pump actuating electric motor and which discharges a hydraulic oil, and a hydraulic actuator which is supplied with the hydraulic oil discharged from the hydraulic pump and which actuates the working portion attached to the boom.

According to the present invention there is provided in a further aspect thereof a battery-powered working machine including a rotatable superstructure carried on a lower carriage rotatably, a boom attached to the rotatable superstructure so as to be capable of rising and falling, a working portion attached to the boom, and a battery as a drive source, the working machine further including a boom actuating electric motor which is supplied with electric power from the battery and which actuates the boom directly, a rotating electric motor which is supplied with electric power from the battery and which directly causes the rotatable superstructure to rotate, a hydraulic pump actuating electric motor which is supplied with electric power from the battery and which actuates a hydraulic pump, the hydraulic pump which is actuated by the hydraulic pump actuating electric motor and which discharges a hydraulic oil, and a hydraulic actuator which is supplied with the hydraulic oil discharged from the hydraulic pump and which actuates the working portion attached to the boom.

In these working machines, since the boom and the rotatable superstructure are actuated directly by electric motors (that is, they are actuated through mechanical means such as reduction gears without through any hydraulic means), the mechanisms associated with the said actuation can be simplified. Besides, when a negative work is performed such as moving down the boom at a predetermined speed against its own weight or braking the rotatable superstructure during rotation, the boom actuating electric motor or the rotating electric motor are allowed to function as a generator, thereby converting the said negative work into an electric energy, which can be recovered in the battery. On the other hand, a hydraulic actuator, which is less heavy than the electric motors, is used for actuating the working portion located farther from the centroid position of the working machine than the boom and the rotatable superstructure. Further, a hydraulic pump is actuated by a hydraulic pump actuating electric motor which uses the battery as a drive source, to supply the hydraulic actuator with hydraulic oil. In this way it is possible to avoid a great increase in inertia moment of the rotatable superstructure and the boom and avoid deterioration of the weight balance of the entire working machine.

The working portion attached to the boom comprises, for example, an arm connected rotatably to the front end portion of the boom and a bucket connected rotatably to the front end portion of the arm. In this connection, it is preferable for the working machine to be provided with an arm actuating hydraulic actuator which is supplied with the hydraulic oil from the hydraulic pump and which causes the arm to rotate and a bucket actuating hydraulic actuator which is supplied with the hydraulic oil from the hydraulic pump and which causes the bucket to rotate.

In the case where tires, which are smaller in frictional resistance with the ground surface than crawlers and which is hence smaller in energy loss caused by the said friction, are used as means for causing the working machine itself to travel, it is preferable for the working machine to be provided with a traveling electric motor which is supplied with an electric power from the battery and which directly causes the tires to rotate. By so doing, it becomes possible to effect the recovery of energy in a still higher efficiency.

DETAILED DESCRIPTION OF THE PREFERRED EMBODIMENTS

The first embodiment of the present invention will be described hereinunder with reference to FIGS. 1 and 2.

Figure 1A:
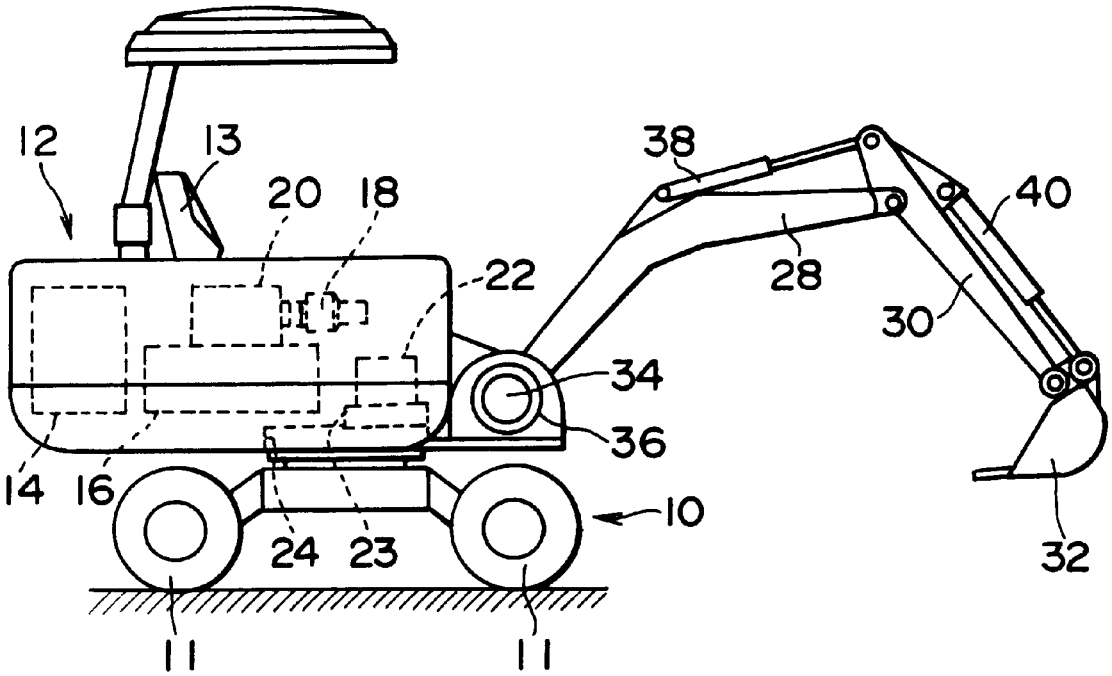
FIG. 1*a* is a front view of a hydraulic excavator according to the first embodiment of the present invention and FIG. 1*b* is a plan view thereof.
Figure 1B:
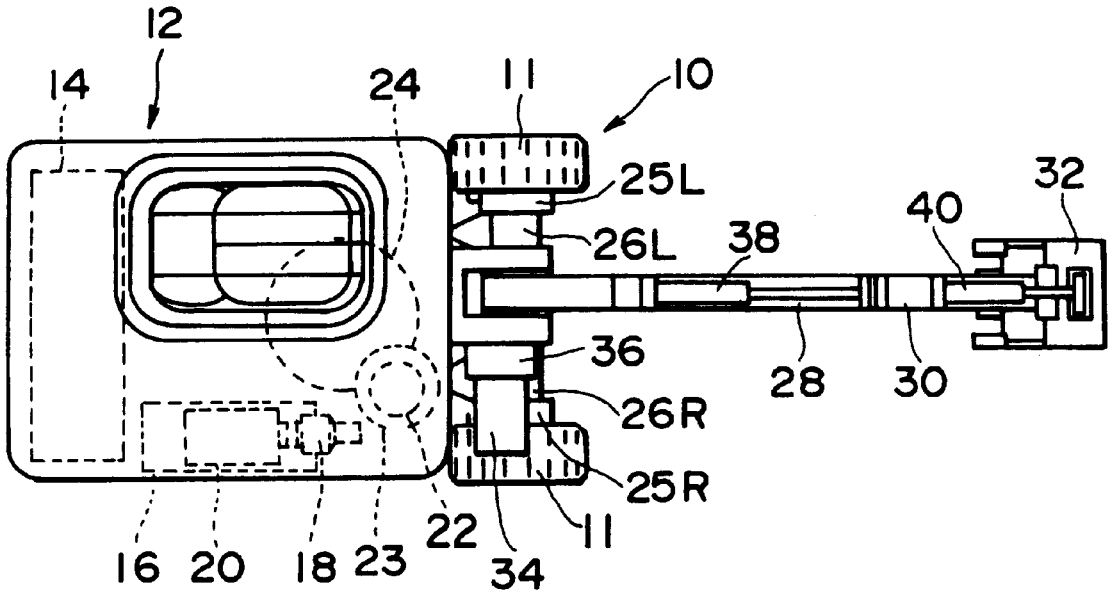

The hydraulic excavator shown in FIG. 1 is provided with a lower carriage 10 having tires 11 for travel. A rotatable superstructure 12 is mounted on the lower carriage 10 so as to be rotatable about a vertical axis. In the rotatable superstructure 12 is provided a cab 13, and further mounted are a battery 14, a hydraulic tank 16, a hydraulic pump 18, a hydraulic pump actuating electric motor 20, and a rotating electric motor 22. The rotating electric motor 22 is connected to a rotating drive mechanism 24 through a reduction mechanism 23. The whole of the rotatable superstructure 12 is rotated by operation of the electric motor 22. Further, a left-hand traveling electric motor 26L and a right-hand traveling electric motor 26R are connected to the front left and right tires respectively through a left-hand reduction mechanism 25L and a right-hand reduction mechanism 25R. The whole of the hydraulic excavator is caused to travel by operation of the electric motors 26L and 26R.

A base end portion of a boom 28 is connected to a front end portion of the rotatable superstructure 12 so as to be rotatable (capable of rising and falling) about a shaft disposed in the transverse direction of the hydraulic excavator. To a front end portion of the boom 28 is connected a base end portion of a arm 30 so as to be rotatable about a shaft disposed in the transverse direction of the excavator, and to a front end portion of the arm 30 is connected a base end portion of a bucket 32 so as to be rotatable about a shaft disposed in the transverse direction of the excavator. An intermediate part of the boom 28 and the base end portion of the arm 30 are connected with each other through an arm cylinder (an actuator for the arm) 38. The arm 30 is rotated by expansion and retraction of the arm cylinder 38. The base end portion of the arm 30 and that of the bucket 32 are connected with each other through a bucket cylinder (an actuator for the bucket) 40. The bucket 40 is rotated by expansion and retraction of the bucket cylinder 40.

Figure 2:
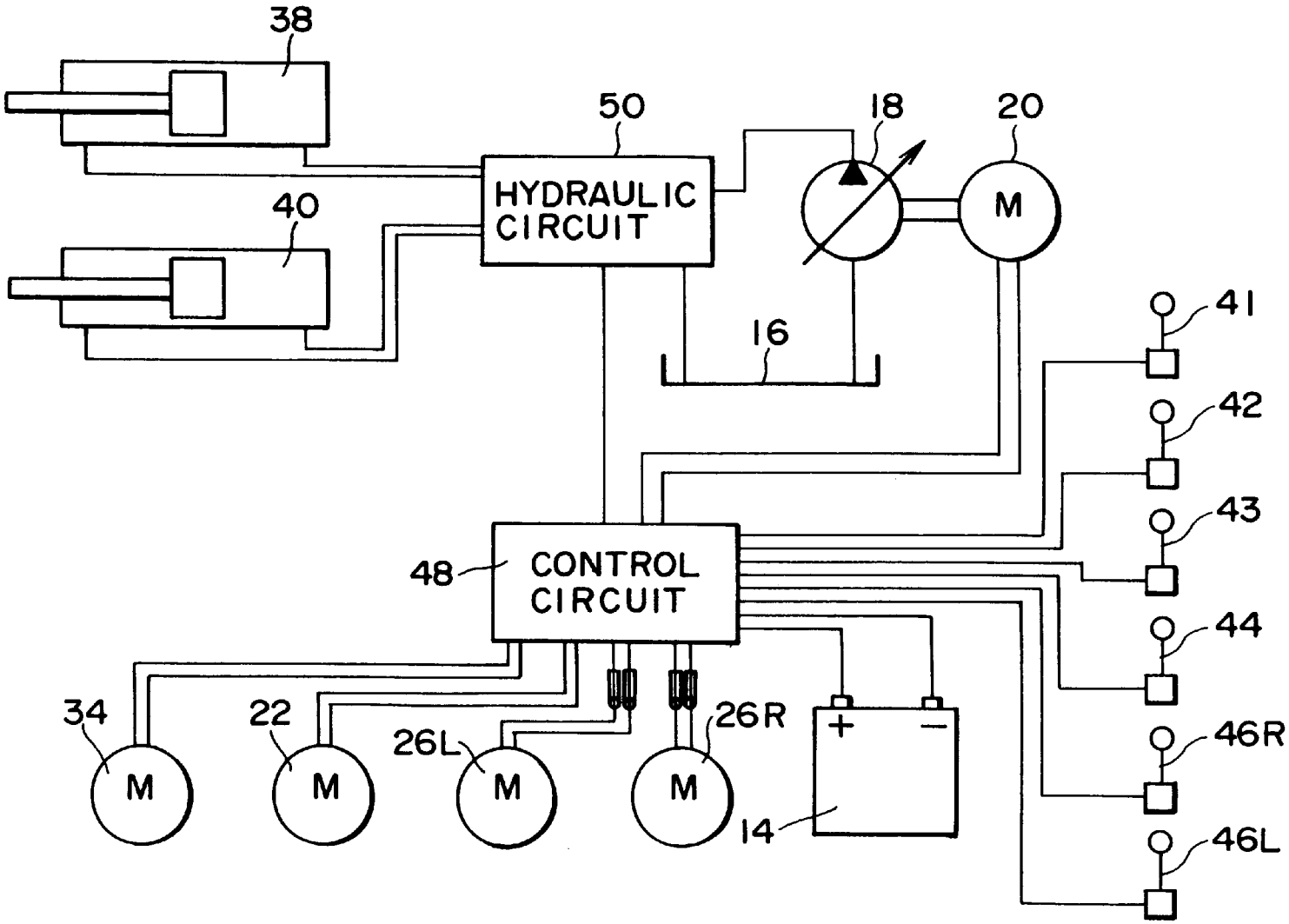
FIG. 2 is a configuration diagram showing drive units mounted on the hydraulic excavator of FIGS. 1*a* and 1*b;*

Drive units mounted on the hydraulic excavator are shown in FIG. 2. An output shaft of the hydraulic pump actuating electric motor 20 is connected to a rotating shaft of the hydraulic pump 18. The hydraulic pump 18 is actuated by operation of the motor 20 and discharges hydraulic oil from the interior of the hydraulic tank 16 to a hydraulic circuit 50. In the hydraulic circuit 50 are provided various control valves such as electromagnetic proportion valves, and the hydraulic oil is fed through the hydraulic circuit to the arm cylinder 38 and the bucket cylinder 40 to expand or retract the arm cylinder and the bucket cylinder.

On the other hand, in the cab 13 are provided a boom operating lever 41, an arm operating lever 42, a bucket operating lever 43, a rotation operating lever 44, a right travel operating lever 46R, and a left travel operating lever 46L. Command signals, which are outputted in accordance with operations of these operating levers, are inputted to a control circuit 48. The hydraulic pump actuating electric motor 20, boom actuating electric motor 34, rotating electric motor 22 and traveling electric motors 26L, 26R are connected to the control circuit 48, to which is also connected the battery 14 as a drive source for those motors. The control circuit 48 is configured to perform the following controlling operations in accordance with the command signals provided from the operating levers.

① Outputs a control signal to the boom actuating electric motor 34 in accordance with operation of the boom operating lever 41 and causes the boom 28 to rise or fall in a direction matching the operating direction and at a speed matching the operation quantity.

② Outputs a control signal to the rotating electric motor 22 in accordance with operation of the rotation operating lever 44 and causes the rotatable superstructure 12 to rotate in a direction matching the operating direction and at a speed matching the operation quantity.

③ Outputs a control signal to the left-hand traveling electric motor 26L in accordance with operation of the left travel operating lever 46L and causes the left tires 11 to rotate in a direction matching the operating direction and at a speed matching the operation quantity. Likewise, the control circuit 48 outputs a control signal to the right-hand traveling electric motor 26R in accordance with operation of the right travel operating lever 46R and causes the right tires 11 to rotate in a direction matching the operating direction and at a speed matching the operation quantity.

④ Outputs control signals to the hydraulic pump actuating electric motor 20 and also to various solenoid valves in the hydraulic circuit 50 in accordance with operation of the arm operating lever 42 and causes the hydraulic oil to be fed to the arm cylinder 38 so that the arm 30 rotates in a direction matching the operating direction and at a speed matching the operation quantity. Likewise, outputs control signals to the hydraulic pump actuating electric motor 20 and also to various solenoid valves in the hydraulic circuit 50 in accordance with operation of the bucket operating lever 43 and causes the hydraulic oil to be fed to the bucket cylinder 40 so that the bucket 32 rotates in a direction matching the operating direction and at a speed matching the operation quantity.

In this hydraulic excavator, the boom 28 is actuated directly by the boom actuating electric motor 34 (that is, actuated mechanically without through any hydraulic means), so when there is performed a negative work of bringing down the boom 28 at a predetermined speed against its own weight, a potential energy of the boom 28 can be converted to an electric energy by the boom actuating electric motor 34, which electric energy can be recovered in the battery 14. Thus, a highly efficient energy can be recovered by allowing the boom actuating electric motor 34 to function as a generator.

Likewise, since the rotatable superstructure 12 is rotated directly by the rotating electric motor 22, when a negative work of braking the rotation of the rotatable superstructure 12 is performed, the rotation energy of the rotatable superstructure can be converted to an electric energy by the rotating electric motor 22, which electric energy can be recovered in the battery 14. Thus, the recovery of a highly efficient energy can be effected by allowing the rotating electric motor 22 to function as a generator. Further, when the traveling of the hydraulic excavator is decelerated, the recovery of energy can be done in the same way as above by allowing the traveling electric motors 26L and 26R to function as generators.

By these recoveries of energy it is possible to effectively increase the continuous working time of the battery 14 while using the battery as a power source. Besides, the boom actuating electric motor 34, rotating electric motor 22 and traveling electric motors 26L, 26R are mounted on the working machine body side (the rotatable superstructure 12 side in the drawings) and are positioned near the center of gravity of the entire working machine, so even if these electric motors 34, 22, 26L and 26R are heavier than the hydraulic actuators, there is little fear that the weight balance of the entire hydraulic excavator may become unstable, nor is there any fear of an increase in inertia moment of the boom 28. Besides, the mechanism for drive is simple. A mere addition of a reduction mechanism suffices.

On the other hand, as arm actuating means and bucket actuating means, which must be attached to the front end side of the boom 28, there are used such hydraulic actuators of a relatively light weight as the arm cylinder 38 and the bucket cylinder 40, so in comparison with the case where electric motors are attached as such arm actuating means and bucket actuating means to the boom 28, the weight of the boom front end portion can be reduced to a great extent and therefore it is possible to prevent the weight balance from becoming unstable and also prevent an increase in inertia moment of the boom.

Although in the above embodiment the arm 30 is connected to the front end portion of the boom 28 and the bucket 32 is also connected thereto through the arm 30, the present invention is also applicable to the case where the bucket 32 is connected directly to the boom 28 (that is, the arm 30 is not used) and the case where the bucket 32 provided at the front end of the arm is not rotated (that is, the bucket actuating means is not used). The present invention is also applicable to a bucket wheel excavator wherein a bucket wheel with plural buckets arranged on a circumference is attached rotatably to the front end of a boom. In this case, a hydraulic actuator (say, a hydraulic motor) may be used as means for rotating the bucket wheel.

Figure 3A:
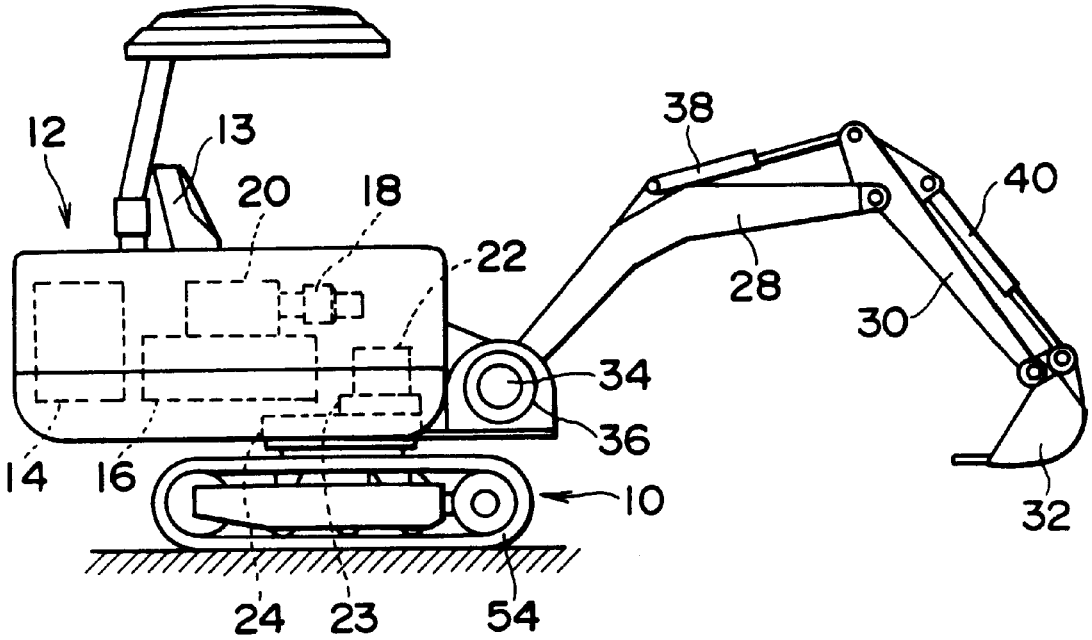
FIG. 3*a* is a front view of a hydraulic excavator according to the second embodiment of the present invention and FIG. 3*b* is a plan view thereof.
Figure 3B:
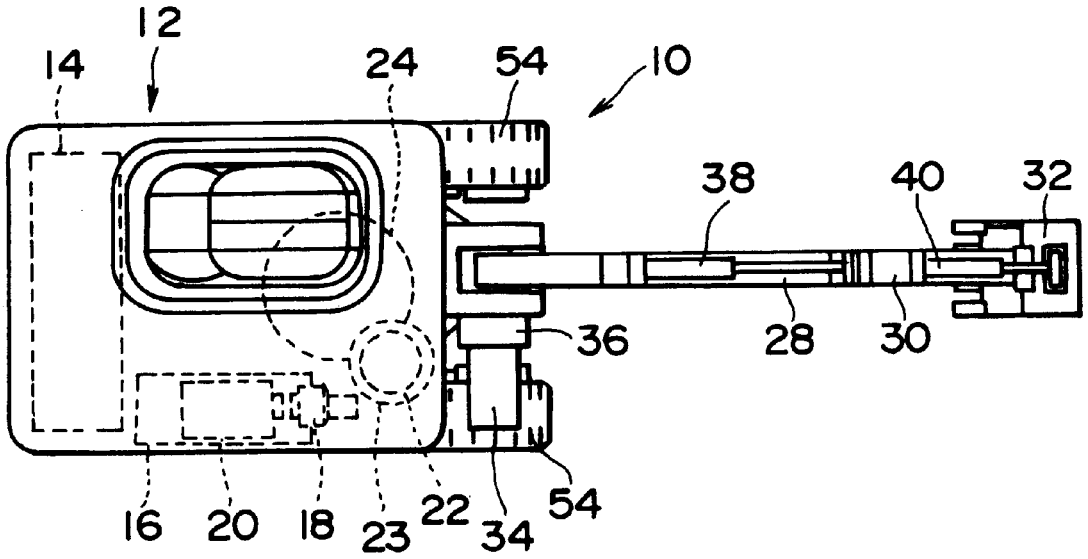
Figure 4:
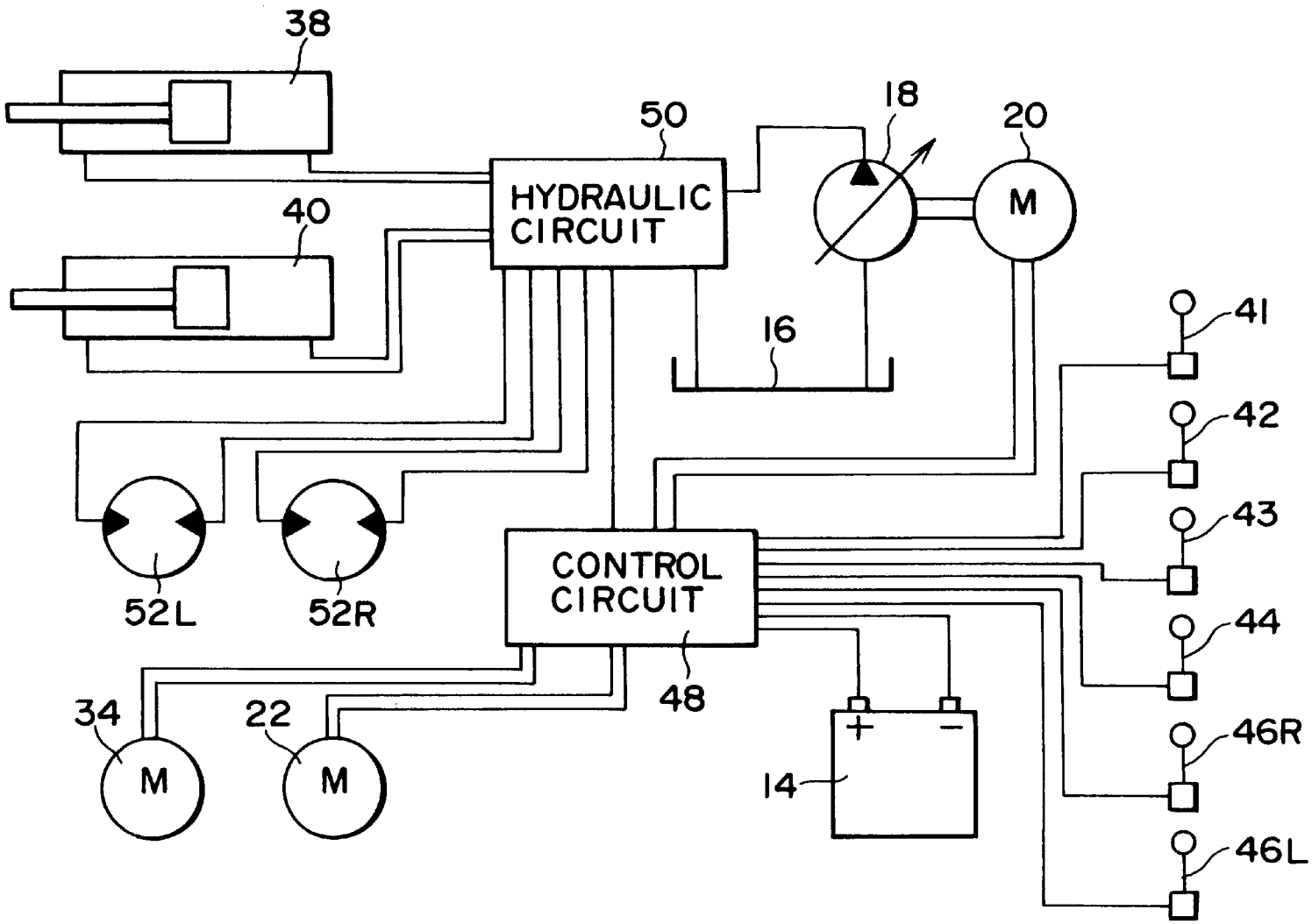
FIG. 4 is a configuration diagram showing drive units mounted on the hydraulic excavator of FIGS. 3*a* and 3*b*.

The traveling electric motors 26L and 26R may be omitted as the case may be. For example, in a working machine using crawlers 54 as traveling means, as shown in FIGS. 3*a* and 3*b* which illustrate the second embodiment of the present invention, a frictional loss caused by contact of the crawlers 54 with the ground surface is large and so it is difficult to effect the regeneration of energy in high efficiency. In this case, such hydraulic actuators as a left-hand traveling hydraulic motor 52L and a right-hand traveling hydraulic motor 2R may be used as traveling means, as shown in FIG. 4, to reduce the weight of the entire working machine.

In the present invention, as set forth above, either the operation of the boom attached to the working machine body so as to be capable of rising and falling or the rotation of the rotatable superstructure carried rotatably on the lower carriage is performed directly by using an electric motor, while the working portion attached to the boom is actuated by means of a hydraulic actuator, further, a hydraulic pump actuating electric motor is rotated with the electric power supplied from the battery and the hydraulic oil is fed to the above hydraulic actuator by means of a hydraulic pump which is actuated by the said hydraulic pump actuating electric motor. Therefore, it is possible to keep low the moment of inertia of the boom, etc. and keep the weight balance of the entire working machine in good condition; at the same time it is possible to effect a highly efficient recovery of energy and thereby increase the continuous working time of the battery.

What is claimed is:

1. A battery-powered working machine including a boom attached to a body of the working machine so as to be capable of rising and falling, a working portion attached to said boom, and a battery as a drive source, said battery-powered working machine comprising:

a boom actuating electric motor which is supplied with electric power from said battery and which actuates said boom directly;

a hydraulic pump;

a hydraulic pump actuating electric motor which is supplied with electric power from said battery and which actuates said hydraulic pump; and a hydraulic actuator which is supplied with hydraulic oil discharged from said hydraulic pump and which actuates said working portion attached to said boom.

2. A battery-powered working machine including a rotatable superstructure carried rotatably on a lower carriage, a boom attached to said rotatable superstructure so as to be capable of rising and falling, a working portion attached to said boom, and a battery as a drive source, said battery-powered working machine comprising:

a rotating electric motor which is supplied with electric power from said battery and which directly causes said rotatable superstructure to rotate;

a hydraulic pump;

a hydraulic pump actuating electric motor which is supplied with electric power from said battery and which actuates said hydraulic pump; and a hydraulic actuator which is supplied with hydraulic oil discharged from said hydraulic pump and which actuates said working portion attached to said boom.

3. A battery-powered working machine including a rotatable superstructure carried on a lower carriage rotatably, a boom attached to said rotatable superstructure so as to be capable of rising and falling, a working portion attached to said boom, and a battery as a drive source, said battery-powered working machine further including:

a boom actuating electric motor which is supplied with electric power from said battery and which actuates said boom directly;

a rotating electric motor which is supplied with electric power from said battery and which directly causes said rotatable superstructure to rotate;

a hydraulic pump;

a hydraulic pump actuating electric motor which is supplied with electric power from said battery and which actuates said hydraulic pump; and a hydraulic actuator which is supplied with hydraulic oil discharged from said hydraulic pump and which actuates said working portion attached to said boom.

4. The battery-powered working machine according to any of claims 1 to 3, wherein said working portion is an arm connected rotatably to a front end portion of said boom and which further includes an arm actuating hydraulic actuator, said arm actuating hydraulic actuator being supplied with the hydraulic oil discharged from said hydraulic pump and causing said arm to rotate.

5. The battery-powered working machine according to any of claims 1 to 3, wherein said working portion comprises an arm connected rotatably to a front end portion of said boom and a bucket connected rotatably to a front end portion of said arm and which further includes a bucket actuating hydraulic actuator, said bucket actuating hydraulic actuator being supplied with the hydraulic oil discharged from said hydraulic pump and causing said bucket to rotate.

6. The battery-powered working machine according to any of claims 1 to 3, wherein said working portion comprises an arm connected rotatably to a front end portion of said boom and a bucket connected rotatably to a front end portion of said arm and which further includes an arm actuating hydraulic actuator, said arm actuating hydraulic actuator being supplied with the hydraulic oil discharged from said hydraulic pump and causing said arm to rotate, and a bucket actuating hydraulic actuator, said bucket actuating hydraulic actuator being supplied with the hydraulic oil discharged from said hydraulic pump and causing said bucket to rotate.

7. The battery-powered working machine according to any of claims 1 to 3, further comprising tires for the travel of said working machine itself and a traveling electric motor which is supplied with electric power from said battery and which directly causes said tires to rotate.

* * * * *